US006883510B2

(12) United States Patent
Wagner et al.

(10) Patent No.: US 6,883,510 B2
(45) Date of Patent: Apr. 26, 2005

(54) MIXTURE ADAPTATION METHOD

(75) Inventors: Jens Wagner, Stuttgart (DE); Peter Kaltenbrunn, Bietigheim-Bissingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/363,122

(22) PCT Filed: Aug. 23, 2001

(86) PCT No.: PCT/DE01/03227

§ 371 (c)(1),
(2), (4) Date: Sep. 22, 2003

(87) PCT Pub. No.: WO02/18766

PCT Pub. Date: Mar. 7, 2002

(65) Prior Publication Data

US 2004/0035405 A1 Feb. 26, 2004

(30) Foreign Application Priority Data

Sep. 2, 2000 (DE) ..... 100 43 256

(51) Int. Cl.[7] ..... F02D 41/00
(52) U.S. Cl. ..... 123/674; 123/693
(58) Field of Search ..... 123/674, 693, 123/676, 685, 686, 690, 694, 695, 696, 679, 486

(56) References Cited

U.S. PATENT DOCUMENTS

| | | | | |
|---|---|---|---|---|
| 4,248,196 A | * | 2/1981 | Toelle | 123/680 |
| 4,432,325 A | | 2/1984 | Auracher et al. | |
| 4,478,194 A | | 10/1984 | Yamato et al. | |
| 4,512,319 A | * | 4/1985 | Williams et al. | 123/492 |
| 4,513,722 A | | 4/1985 | Hasegawa | |
| 4,584,982 A | | 4/1986 | Clement et al. | |
| 4,739,741 A | | 4/1988 | Iwata et al. | |
| 5,074,271 A | | 12/1991 | Suzuki et al. | |

FOREIGN PATENT DOCUMENTS

| | | |
|---|---|---|
| DE | 43 25 844 | 2/1995 |

* cited by examiner

*Primary Examiner*—Mahmoud Gimie
(74) *Attorney, Agent, or Firm*—Kenyon & Kenyon

(57) ABSTRACT

A method for compensating for mismatches of the precontrol of a fuel metering for an internal combustion engine. A regulation being superimposed on the precontrol. At least one correction quantity being formed, from the behavior of the regulation at high temperatures of the internal combustion engine, which influences the fuel metering even at low temperatures of the internal combustion engine in a supplementing manner to the superimposed regulation for compensating for the mismatches. At low temperatures a further correction quantity is formed which acts upon the fuel metering, whose effect at low temperatures of the internal combustion engine is greater than at high temperatures.

12 Claims, 3 Drawing Sheets

MIXTURE ADAPTATION METHOD

FIELD OF THE INVENTION

The present invention relates to a method and an electronic control device for compensating for mismatches of the precontrol of a fuel metering for an internal combustion engine.

BACKGROUND INFORMATION

In the regulation of fuel/air ratios for internal combustion engines, a regulation may be superimposed on precontrol. Further correction quantities may be derived from the behavior of the regulated quantity, in order to compensate for mismatches of the precontrol to changed operating conditions. This compensation is also called adaptation. U.S. Pat. No. 4,584,982, for example, discusses an adaptation having different adaptation quantities in different ranges of the load/speed spectrum of an internal combustion engine. The various adaptation quantities are directed towards the compensation of different errors. With respect to cause and effect, three types of error may be distinguished: Errors of a hot film air mass meter have a multiplicative effect on fuel metering. Unmetered air influences have an additive effect per time unit, and errors in the compensation of the response delay of the fuel injectors have an additive effect per injection.

It has been shown that, even at complete adaptation in the hot state, mismatches at low engine temperatures continue to appear, which disappear again at higher temperatures.

SUMMARY OF THE INVENTION

The present invention provides for compensation for the temperature-conditioned mismatches, which are not observable when the engine is hot.

In particular, according to the present invention, a compensation of mismatches of precontrol of fuel metering in an internal combustion engine occurs, such that:

- a regulation being superimposed on the precontrol,
- at least one correction quantity being formed, from the behavior of the regulation at high temperatures of the internal combustion engine, which influences the fuel metering even at low temperatures of the internal combustion engine in a complementing manner to the superimposed regulation for the compensation of the mismatches, and
- at low temperatures, a further correction quantity being formed which has an effect upon the fuel metering in such a manner that its effect at lower temperatures of the internal combustion engine is greater than at high temperatures of the internal combustion engine.

A further measure provides that, for the formation of a further additional correction quantity (frat), the deviation of an average regulating controlled variable form from the value 1 at comparably low engine temperatures T is integrated.

In another exemplary embodiment of the present invention, the integration at engine temperatures T is performed over a temperature interval TMN<T<TMX.

According to another exemplary embodiment, TMN as the lower interval limit amounts to 10–30° C., especially 20° C., and TMX as the upper interval limit corresponds to that temperature at which the usual adaptation is activated.

According to still another exemplary embodiment, TMX is approximately 70° C.

A further exemplary embodiment provides that the one further correction quantity, which acts upon the fuel metering in such a manner that its effect at low temperatures of the internal combustion engine is greater than at high temperatures of the internal combustion engine, is changed as a function of the engine temperature in such a manner that, at high temperatures, no differences from the adaptation in a hot engine occur.

According to one additional exemplary embodiment, the output frak of the integrator is linked to a temperature-dependent quantity ftk in such a manner that the result of the linkage decreases with increasing temperature.

Then, according to another exemplary embodiment, the temperature-dependent quantity ftk may form a multiplicative correction varying between zero and one, the value zero occuring when the engine is hot.

The correction may vary continuously between these extreme values.

According to one further exemplary embodiment, the integration speed may be dependent upon the values for the load and the speed of the engine.

Also, the present invention provides an electronic control device for performing the method and exemplary embodiments described above.

According to the present invention, the use of a further temperature-dependent adaptation quantity compensates for the above-mentioned mismatch of the precontrol at low engine temperatures. In the diagnosis of a secondary air system, which is active at low engine temperatures, a certain statement may be made concerning the secondary air mass flow. Besides that, the compensation for the temperature-dependent error relieves the lambda regulation at subsequent cold starts.

If the normal mixture adaptation is active at a high engine temperature, it learns, among other things, the density of the fuel. At a low temperature, the fuel has a greater density than at high temperature, and thus, the precontrol at high temperatures is no longer correct. The present invention provides for the additional adaptation of the precontrol at low temperature.

DETAILED DESCRIPTION

Figure 1:
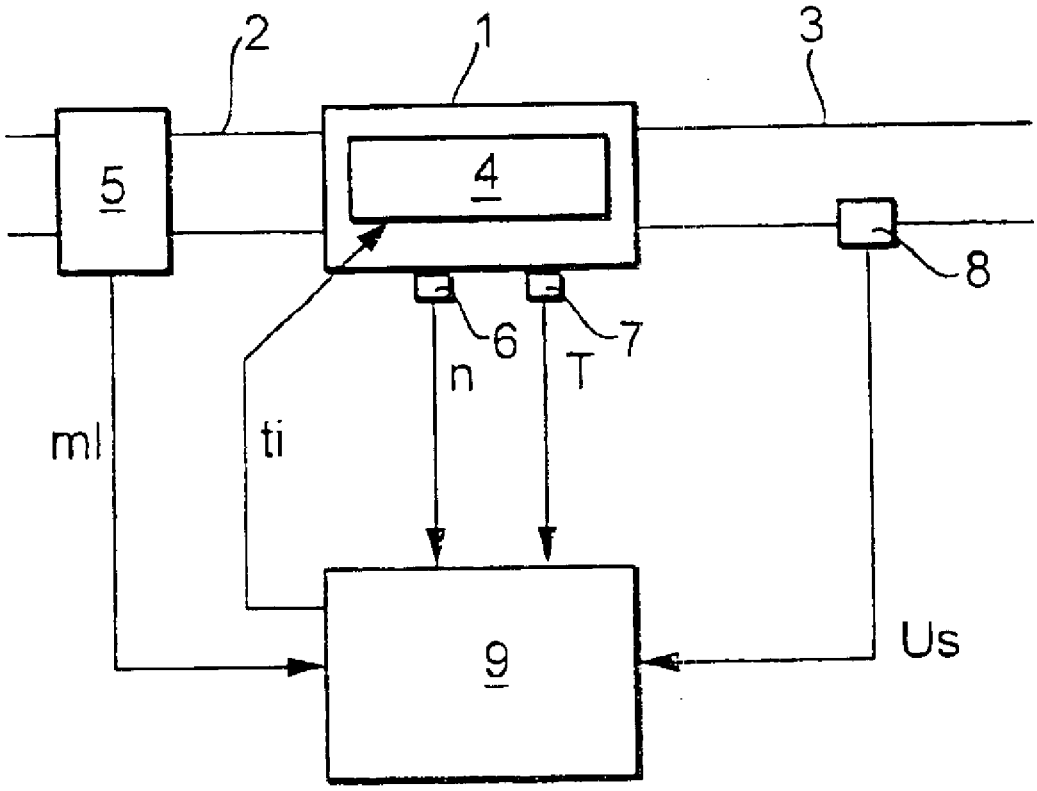
FIG. 1 shows the technical environment of the present invention.

The number 1 in FIG. 1 represents an internal combustion engine including an intake manifold 2, an exhaust pipe 3, a fuel metering arrangement 4, sensors 5–8 for operating parameters of the engine and a control unit 9. The fuel metering arrangement 4 may, for example, be made up of an arrangement of fuel injectors for the direct injection of fuel into the combustion chambers of the internal combustion engine.

Sensor 5 supplies a signal to the control unit concerning the air mass ml aspirated by the engine. Sensor 6 supplies an engine speed signal n. Sensor 7 makes available the engine temperature T, and sensor 8 supplies a signal Us concerning the exhaust gas composition of the engine. From these signals, and other signals, if necessary, regarding additional operating parameters of the engine, the control unit, besides additional controlled variables, forms fuel metering signal ti for controlling fuel metering arrangement 4 in such a manner that a desired behavior of the engine sets in, especially a desired exhaust gas composition.

Figure 2:
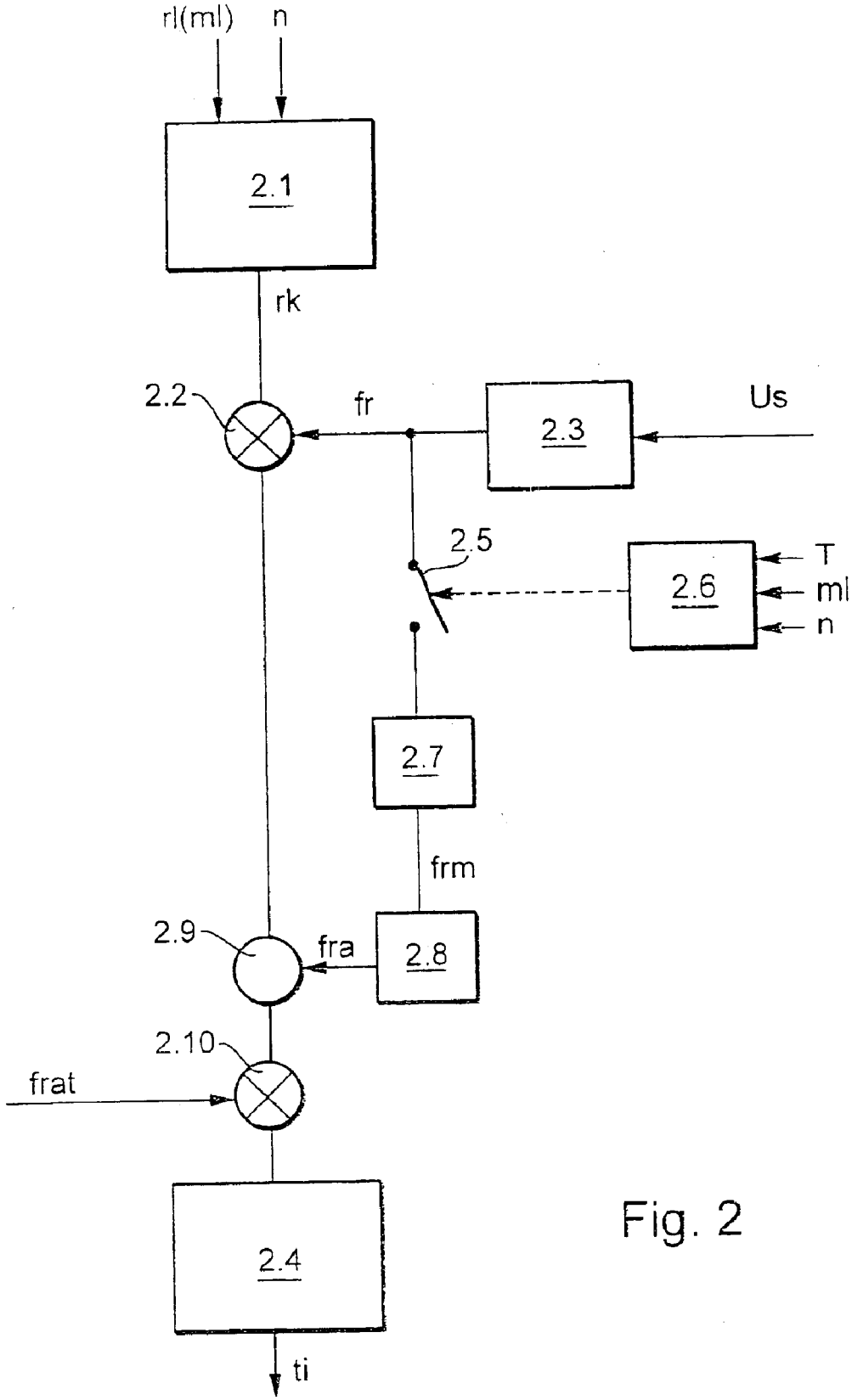
FIG. 2 makes clearer the formation of a fuel metering signal on the basis of the signals from FIG. 1.

FIG. 2 shows the formation of the fuel-metering signal. Block 2.1 represents a characteristics map, which is addressed by rotational speed n and the relative air charge rl, and in which precontrol values rk for generating the fuel-metering signals are stored. Relative air charge rl is related to a maximum charge of the combustion chamber with air and, to some extent, thus indicates the fraction of the maximum combustion chamber or cylinder charge. It is formed from signal ml. The quantity rk corresponds to the fuel quantity associated with air quantity rl.

Block 2.2 shows the multiplicative lambda control adjustment. A mismatch of the fuel quantity to the air quantity is reflected in signal Us of the exhaust-gas probe. A controller 2.3 forms regulated controlled variable fr from this, which reduces the mismatch via adjustment 2.2.

From the signal thus corrected, the metering signal, for instance a control pulse width for the fuel injectors, may already be generated in block 2.4. Block 2.4, therefore, represents the conversion of the relative and corrected fuel quantity into an actual control signal, taking into account the fuel pressure, injector geometry, etc.

Blocks 2.5 through 2.9 represent the mixture adaptation based on operating parameters, which may have a multiplicative and/or an additive effect. Circle 2.9 is meant to represent these three possibilities. Switch 2.5 is opened or closed by arrangement 2.6, operating parameters of the internal combustion engine, such as temperature T, air mass ml and rotational speed n being supplied to arrangement 2.6. Arrangement 2.6 in conjunction with switch 2.5 thus permits an activation of the three named adaptation possibilities as a function of operating parameter ranges. The formation of adaptive adjustment fra for the fuel-metering signal generation is shown by blocks 2.7 and 2.8. Block 12.7 forms the average value form of regulating controlled variable fr when switch 2.5 is closed. Deviations of average value form from neutral value 1 are incorporated by block 2.8 into adaptation adjustment variable fra. For instance, let us say regulating controlled variable fr, due to a mismatch of the precontrol, first goes toward 1.05. Block 2.8 incorporates the 0.05 deviation from value 1 into value fra of the adaptive adjustment. In case of a multiplicative fra adjustment, fra then goes toward 1.05, with the result that fr will go toward 1 again. In this manner, the adaptation ensures that mismatches of the precontrol do not require renewed adjustment at each change of operating points. This adjustment of adaptation quantity fra is performed at high temperatures of the internal combustion engine, such as above a cooling water temperature of 70° C., switch 2.5 being then closed. However, once adjusted, fra also has an effect on the formation of the fuel metering signal when switch 2.5 is open.

This adaptation is supplemented, within the framework of the present invention, by a further correction frat, which becomes effective in the linkage 2.10.

Figure 3:
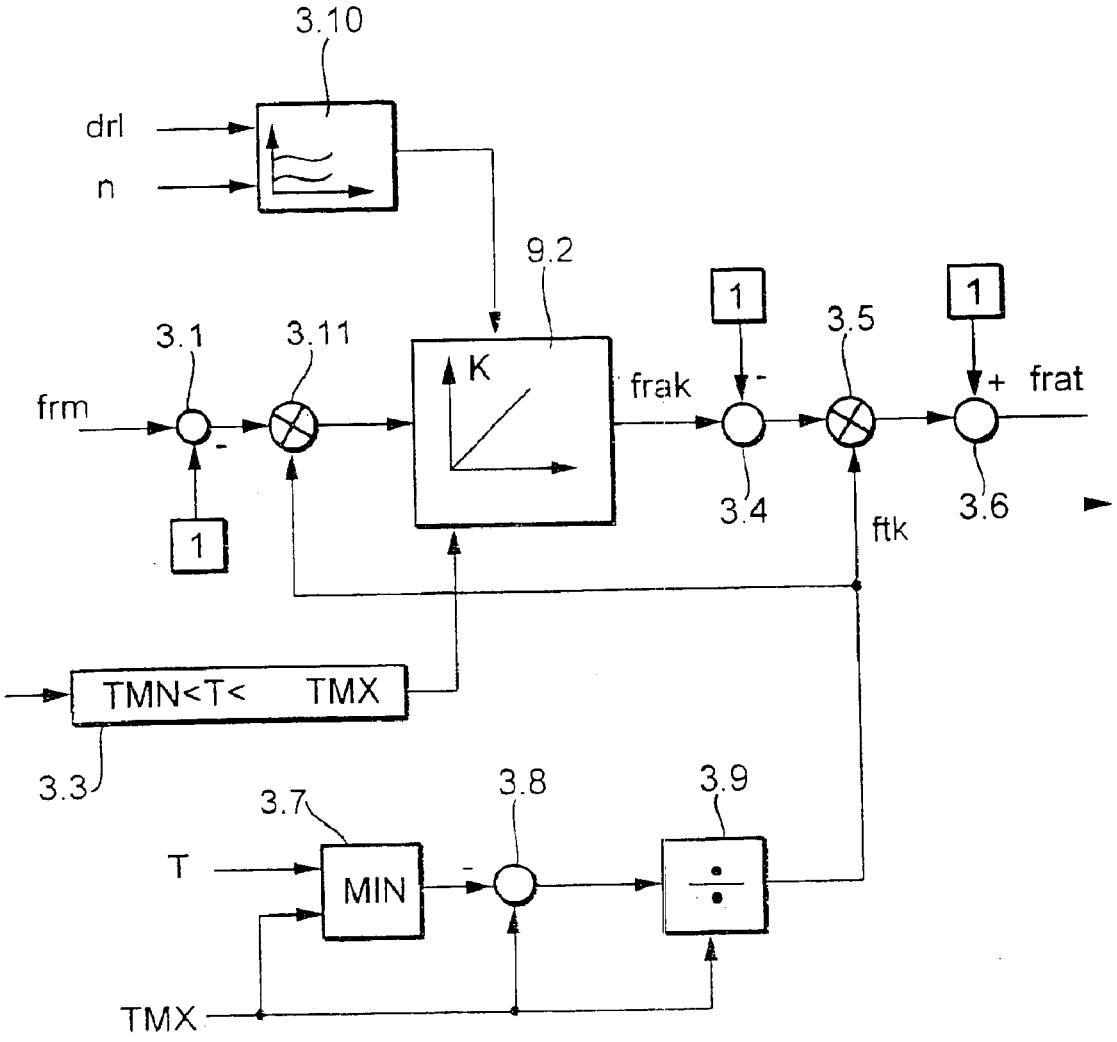
FIG. 3 shows the development of an intervention, according to the present invention, in the formation of the fuel metering signal in the form of function blocks as the exemplary embodiment of the present invention.

An exemplary embodiment of the frat formation is shown in FIG. 3. Block 3.1 supplies the deviation of the average regulating controlled variable form from value 1 to an integrator block 3.2 (not shown). Block 3.3 activates the integrator for comparatively low engine temperatures T from an interval TMN<T<TMX. TMN as the lower interval limit may, for instance, be 10–30° C., especially 20° C.; TMX as the upper interval limit may, for instance, correspond to the temperature at which the usual adaptation is activated via the closing of switch 2.5. A typical value for this temperature is 70° C.

The output value of the integrator, using the value frak, supplies a measure for the mismatch in a comparatively cool engine.

A feature of the present invention is taking into consideration this value for a cool engine in the formation of the fuel metering signal, without there being yielded, at high temperatures, differences for the adaptation in hot engines.

This is achieved, for example, by blocks 3.4 to 3.6 and 2.10.

The important thing is, first of all, the linkage of the integrator output frak with a temperature-dependent quantity ftk, the linkage having to accomplish the feature mentioned, of the present invention. In the example, ftk represents a multiplicative correction between zero and one. The value zero occurs for a hot engine, i.e. at T>TMX. Then the minimum selection in block 3.7 supplies the value TMX. In block 3.8 the value zero is produced, as the difference between TMX and TMX, which is supplied to the quotient formation in block 3.9 as numerator. Block 3.8 correspondingly supplies the value zero as the magnitude of the temperature dependent quantity ftk. To this value ftk=zero, the value 1 is added in block 3.6. According to this, the sum frat has the value 1, and accordingly it does not change the fuel metering signal formation for a hot engine, in the case of the multiplicative linkage in block 2.10. In other words: For a hot engine, ftk has a maximum weakening effect on frak. Therefore, the quantity frak is not effective at all when the engine is hot, in the extreme case sketched here. When the engine is cool, such as when T=zero ° C., the minimum selection supplies the value zero, and the subsequent quotient formation supplies the value 1. The quantity ftk is then neutral and acts upon frak in a minimally weakening manner. In order to compensate for the addition of the 1 in block 3.6 for this case, there is a subtraction of 1 in block 3.4. For a cool engine (T=zero), ftk=1. In that case, $frat_{(ftk=1)}=(frak-1)\cdot ftk+1=frak$ acts like an unchanged value frak, and thus not weakened, upon the fuel metering signal formation. In other words: The further adaptive correction according to the present invention acts only when the engine is cool. The correction varies continuously between the extreme values described.

Characteristics map 3.10 supplies values K for the integration speed in integrator 3.2 as a function of values for drl and n. The quantity drl is the change of the aspirated air mass, which, for example, in the case of transitional operating conditions is especially large. In this manner, in the transitional operating conditions, the mismatches have an effect on the adaptation only in a weakened form.

What is claimed is:

1. A method for compensating for mismatches of a precontrol of a fuel metering for an internal combustion engine, the method comprising:

superimposing a regulation on the precontrol;

adapting at least one first correction quantity based on a behavior of the regulation at high temperatures of the internal combustion engine;

influencing the fuel metering via the at least one first correction quantity even at low temperatures of the internal combustion engine in a supplementary manner to the superimposed regulation for compensating for mismatches; and providing a temperature-dependent adaptation of a further correction quantity which acts upon the fuel metering, an effect of the further correction quantity at low temperatures of the internal combustion engine being greater than at high temperatures.

2. The method of claim 1, wherein for forming the further correction quantity, a deviation of an average regulating controlled variable from a value is integrated at comparatively low engine temperatures.

3. The method of claim 2, wherein integration at engine temperatures T is activated from a temperature interval TMN<T<TMX.

4. The method of claim 3, where TMN as a lower interval limit is 0–30° C. and TMX as an upper interval limit corresponds to a temperature at which adaptation is activated.

5. The method of claim 4, wherein TMN is 20° C.

6. The method of claim 1, wherein TMX is approximately 70° C.

7. The method of claim 1, wherein the further correction quantity is changed as a function of an engine temperature so that, at high temperatures, no differences from an adaptation in a case of a hot engine occur.

8. The method of claim 7, wherein an output of an integrator is linked to a temperature-dependent quantity in such that a result of linkage becomes smaller with increasing temperature.

9. The method of claim 8, wherein the temperature-dependent quantity forms a multiplicative correction varying between zero and one, value zero occuring for a hot engine.

10. The method of claim 9, wherein the multiplicative correction varies continuously between its extreme values.

11. The method of claim 1, wherein an integration speed is a function of values for load and rotational speed of the internal combustion engine.

12. An electronic control unit of an internal combustion engine which performs a method for compensating for mismatches of a precontrol of a fuel metering for an internal combustion engine including:

a superimposing arrangement to superimpose a regulation on the precontrol;

an adapting arrangement to adapt at least one first correction quantity on a basis of a behavior of the regulation at high temperatures of the internal combustion engine;

an influencing arrangement to influence the fuel metering via the at least one first correction quantity even at low temperatures of the internal combustion engine in a supplementary manner to the superimposed regulation for compensating for mismatches; and an arrangement to provide a temperature-dependent adaptation of a further correction quantity which acts upon the fuel metering, an effect of the further correction quantity at low temperatures of the internal combustion engine being greater than at high temperatures.

* * * * *

UNITED STATES PATENT AND TRADEMARK OFFICE

CERTIFICATE OF CORRECTION

PATENT NO. : 6,883,510 B2
DATED : April 26, 2005
INVENTOR(S) : Wagner et al.

It is certified that error appears in the above-identified patent and that said Letters Patent is hereby corrected as shown below:

Column 1,
Line 56, change “controlled variable form” to -- controlled variable frm --.

Column 5,
Line 12, change “limit is 0-30° C.” to -- limit is 10-30° C. --.

Signed and Sealed this

Thirteenth Day of September, 2005

JON W. DUDAS
*Director of the United States Patent and Trademark Office*